US007827627B2

(12) United States Patent
Dayton et al.

(10) Patent No.: US 7,827,627 B2
(45) Date of Patent: Nov. 9, 2010

(54) DUAL-DETENT RETROFITABLE TOILET FLUSH ASSEMBLY

(75) Inventors: Douglas C. Dayton, Harvard, MA (US); Timothy L. Moulton, Newport, RI (US)

(73) Assignee: Buildings and Matters, LLC, Lincoln, MA (US)

( * ) Notice: Subject to any disclaimer, the term of this patent is extended or adjusted under 35 U.S.C. 154(b) by 51 days.

(21) Appl. No.: 12/436,272

(22) Filed: May 6, 2009

(65) Prior Publication Data

US 2009/0276946 A1 Nov. 12, 2009

Related U.S. Application Data

(60) Provisional application No. 61/050,865, filed on May 6, 2008, provisional application No. 61/120,726, filed on Dec. 8, 2008.

(51) Int. Cl.
*E03D 1/14* (2006.01)

(52) U.S. Cl. ..... 4/325

(58) Field of Classification Search ..... 4/324–325
See application file for complete search history.

(56) References Cited

U.S. PATENT DOCUMENTS 5,157,795 A * 10/1992 Pasquin ..... 4/324
5,450,634 A 9/1995 Mohrman
5,511,253 A * 4/1996 Zamudio-Castillo et al. ... 4/325
5,669,082 A * 9/1997 Sun ..... 4/325
6,691,332 B2 * 2/2004 Khoo ..... 4/325

FOREIGN PATENT DOCUMENTS

KR 200401453 11/2005
KR 200427510 9/2006
WO WO-2009137566 A2 11/2009

OTHER PUBLICATIONS

"International Application Serial No. PCT/US2009/042964, Search Report and Written Opinion mailed Dec. 30, 2009", , 10 Pgs.

* cited by examiner

*Primary Examiner*—Charles Phillips
(74) *Attorney, Agent, or Firm*—Strategic Patents, P.C.

(57) ABSTRACT

The present invention provides a two-level flush assembly that can be retrofitted to virtually any toilet with a tank that provides two different water volumes for toilet flushing with a full tank flush for heavy waste and a partial tank flush for light or liquid waste. The flush assembly may use the existing handle and provide tactile feedback for each of the two flush volumes. The two levels of flushing action may be achieved with two independent detent-latch mechanisms, one on each side of the tower, operating on the single toilet flapper. Two independent floats may be utilized, each connected to a release mechanism on either side of the flapper and the water level that supports the float may determine when the flapper is released to close on its seat. The two floats may be set at two different water depths providing a flushing action releasing different volumes of water.

11 Claims, 9 Drawing Sheets

DUAL-DETENT RETROFITABLE TOILET FLUSH ASSEMBLY

CROSS-REFERENCE TO RELATED APPLICATIONS

This application claims the benefit of the following provisional applications, each of which is hereby incorporated by reference in its entirety:

U.S. Provisional Application No. 61/050,865, filed May 6, 2008; and U.S. Provisional Application No. 61/120,726, filed Dec. 8, 2008.

BACKGROUND

While toilet manufacturers have made strides in reducing the volume of water required to flush a toilet, the standard amount of water held in the standard toilet tank may be more than needed for light waste loads. Many toilets in the world use much more than the current standard and an improvement in volume flushed can save a great quantity of water. Considerable water can be saved if a light flush option is provided by the tank flushing system.

There remains a need for a two level flushing mechanism that provides control and permits the user to choose the appropriate flush duration within a single handle mechanism. While many people may be reluctant to hire a plumber to re-plumb their toilet, a device that is retrofittable in the same simple manner that a new flapper is installed would likely be readily accepted and self-installed by most.

SUMMARY

The present invention provides a two-level flush assembly that can be retrofitted to virtually any toilet with a tank and may provide two different water volumes for toilet flushing with a full tank flush for heavy waste and a partial tank flush for light or liquid waste. The flush assembly may use the existing handle and provide tactile feedback for each of the two flush volumes. The two levels of flushing action may be achieved with two independent detent-latch mechanisms, one on each side of the flapper and tower, operating on the single toilet valve flap. Two independent floats may be utilized, each connected to a release mechanism on either side of the flapper and the water level that supports the float may determine when the flapper is released to close the valve. The two floats may be set at two different water depths each providing a flushing action releasing different volumes of water.

In an aspect of the invention, a dual-detent toilet flush assembly and a method of use may comprise a chain attached to a toilet flush handle on one end and a flapper on the other end, wherein when a user pushes the toilet handle, the chain may lift the flapper away from its valve seat; a first flush pivot arm of the valve attached to one side of the flapper, wherein the first flush pivot arm may intercept a detent mechanism when the flapper rises part way from its seat and may hold the flapper open in a first open position; a second flush pivot arm of the valve attached on the other side of the flapper, wherein the second flush pivot arm may intercept a detent mechanism when the flapper rises to a second open position where it may be held open; a first flush float positioned along a detent rack on the same side of the assembly as the first flush pivot arm, wherein the buoyancy of the float may create an upward force upon the detent rack and may provide a force to the detent itself which is held against a bearing surface of the first flush pivot arm; a second flush float positioned along a detent rack on the same side of the assembly as the second flush pivot arm and at a position lower than the first flush float, wherein the buoyancy of the second flush float may create an upward force upon the detent rack and may provide a force to the detent itself which is held against a bearing surface of the second flush pivot arm; wherein when the flapper is opened to a first flush position, a detent may engage with a slot in the first flush pivot arm as it rotates into direct proximity and water begins to drain from the tank until dropping below the level of the first flush float where the first flush float may lose buoyancy and a water weight carried by the upper float reservoir creates a negative buoyancy and a downward disengagement force sufficient to cause the detent to disengage from the first flush pivot arm and the flapper to drop closed on its valve seat; and wherein when the flapper is opened to a second flush position, a detent engages with a slot in the second flush pivot arm as it rotates into direct proximity and water may begin to drain from the tank until dropping below the level of the second flush float where the second flush float loses buoyancy and a water weight carried by the upper float reservoir may create a negative buoyancy and a downward disengagement force sufficient to cause the detent to disengage from the second flush pivot arm and the flapper to drop closed on its valve seat. In the assembly and method, a user may feel resistance on the handle when the first flush pivot arm is engaged by its detent latch. In the assembly and method, the resistance arises when the flapper opening to a first flush position causes a clip disposed on its top and rotating on an axis to contact a surface of a connection boss of the flapper and inhibit its further motion. As more force is employed to overcome the resistance of the clip, the arms of the clip may deform creating a stronger resistance at the lever and effectively stopping the motion of the flapper at the first flush position. The clip may be a spring metal wireform force clip. When enough force is applied, the clip may deform and snap off of the surface of the connection boss thereby freeing the flapper to rotate to the second flush position. The clip may snap into an entrapment feature of the connection boss keeping it from interfering with the chain when the flapper drops closed. In the assembly and method, the two locked open positions may correspond to the amount of water that is released during the flush. In the assembly and method, the first and second flush floats may be repositionable along the detent rack to modify the amount of water released during each flush.

In an aspect of the invention, a dual-detent toilet flush assembly, may include a flapper pivotally attached to a detent mechanism, wherein a connector is attached to a toilet flush handle on one end and to a connection point of the flapper on the other end, wherein when a user engages the toilet flush handle, the connector lifts the flapper away from a flapper seat, a first flush pivot arm attached to a first side of the flapper, wherein the first flush pivot arm interacts with a detent mechanism when the flapper rises part way from the flapper seat and holds the flapper open in a first open position, a second flush pivot arm attached to a second side of the flapper, wherein the second flush pivot arm interacts with a detent mechanism when the flapper rises to a second open position where it is held open, a first flush float associated with the detent mechanism on the same side of the assembly as the first flush pivot arm, wherein the buoyancy of the float creates a force upon the detent mechanism, a second flush float associated with the detent mechanism on the same side of the assembly as the second flush pivot arm and at a position different from the first flush float, wherein the buoyancy of the second flush float creates a force upon the detent mechanism, wherein when the flapper is opened to a first flush position upon engagement of the toilet flush handle: a) the first flush pivot arm tilts and interacts with the detent mechanism on the same side of the assembly as the first flush pivot arm to allow the detent mechanism to move in response to a change in the water level; b) upon a drop in water level, the detent mechanism shifts downward; c) at an endpoint of the downward shift of the detent mechanism, the first flush pivot arm disengages from the detent mechanism and the flapper drops closed on the flapper seat, and wherein when the flapper is opened to a second flush position upon engagement of the toilet flush handle: a) the second flush pivot arm tilts and interacts with the detent mechanism on the same side of the assembly as the second flush pivot arm to allow the detent mechanism to move in response to a change in the water level, b) upon a drop in water level, the detent mechanism shifts downward, c) at an endpoint of the downward shift of the detent mechanism, the second flush pivot arm disengages from the detent mechanism and the flapper drops closed on the flapper seat. A user may feel resistance on the toilet flush handle when the first flush pivot arm interacts with the detent mechanism. The resistance may arise when the flapper opening to a first flush position causes a clip disposed on the top of the flapper and rotating on an axis to contact a surface of a connection boss of the flapper and inhibit the flapper's further motion. As more force is employed to overcome the resistance of the clip, the arms of the clip may deform creating a stronger resistance at the lever and effectively stopping the motion of the flapper at the first flush position. The clip may be a spring metal wireform force clip. When enough force is applied, the clip may deform and snap off of the surface of the connection boss thereby freeing the flapper to rotate to the second flush position. The clip may snap into an entrapment feature of the connection boss keeping it from interfering with the chain when the flapper drops closed. In the assembly, the first and second flush positions correspond to two different amounts of water that may be released during the flushes. In the assembly, the first and second flush floats may be repositionable along the detent mechanism to modify the amount of water released during each flush. In the assembly, the connector may be a chain. In the assembly, upon the drop in water level, the first flush float may lose buoyancy and a water weight carried by an upper float reservoir of the first flush float may create a negative buoyancy and a downward disengagement force sufficient to cause the downward shift of the detent mechanism. In the assembly, upon the drop in water level, the second flush float may lose buoyancy and a water weight carried by an upper float reservoir of the second flush float may create a negative buoyancy and a downward disengagement force sufficient to cause the downward shift of the detent mechanism. In the assembly, the first flush pivot arm may interact with the detent mechanism through a slot in the first flush pivot arm engaging a detent of the detent mechanism as the first flush pivot arm rotates into direct proximity of the detent. In the assembly, the second flush pivot arm may interact with the detent mechanism through a slot in the second flush pivot arm engaging a detent of the detent mechanism as the second flush pivot arm rotates into direct proximity of the detent.

In an aspect of the invention, a kit for in situ retrofitting a gravity tank toilet for enabling a user to select between two flush volumes may include a detent mechanism assembly, at least one float slidably attached to the detent mechanism assembly, and a flapper pivotably attached to the detent mechanism assembly, wherein installation of the detent mechanism assembly in the gravity tank toilet is accomplished without removal of an existing tank. In the kit, installation of the detent mechanism assembly in the gravity tank toilet may utilize an existing flapper seat. In the kit, the at least one float is repositionable along the detent mechanism assembly to enable two selected flush volumes. The selected flush volumes may be based on a parameter of the gravity tank toilet. The selected flush volumes may be selected based on a preference of a user.

In an aspect of the invention, a kit for in situ retrofitting a gravity tank toilet for enabling a user to utilize an existing toilet flush handle to enable a dual flush mechanism may include a detent mechanism assembly, at least one float slidably attached to the detent mechanism assembly, and a flapper pivotably attached to the detent mechanism assembly, wherein installation of the detent mechanism assembly in the gravity tank toilet utilizes an existing toilet flush handle. The kit may further include a clip disposed on the top of the flapper, wherein the clip is adapted to rotate on an axis to contact a surface of a connection boss of the flapper and inhibit the flapper's motion.

These and other systems, methods, objects, features, and advantages of the present invention will be apparent to those skilled in the art from the following detailed description of the preferred embodiment and the drawings.

All documents mentioned herein are hereby incorporated in their entirety by reference. References to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context.

BRIEF DESCRIPTION OF THE FIGURES

The invention and the following detailed description of certain embodiments thereof may be understood by reference to the following figures.

DETAILED DESCRIPTION

Figure 1:
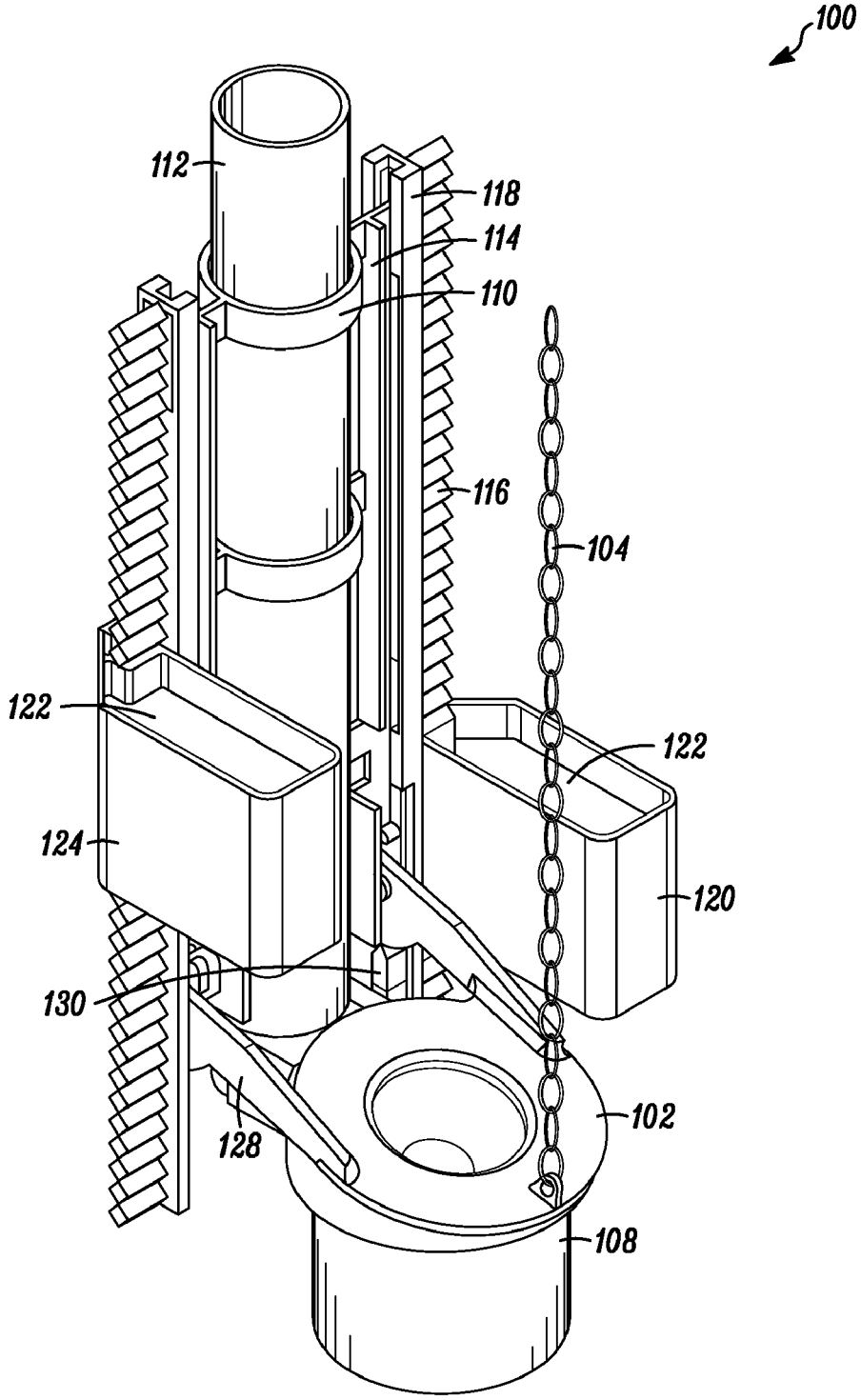
FIG. 1 depicts a perspective view of the dual-detent toilet flush assembly.

Referring to FIG. 1, the dual-detent toilet flush assembly 100 may be adaptable to a wide range of toilets and may provide the user with the choice of two selectable volumes of water that may be released from the tank to flush the toilet. The dual-detent toilet flush assembly 100 may have a chassis 110 that may mount to an existing tower 112. The chassis 110 may be retrofittable. The chassis 110 may require few or no tools to install. The assembly may utilize a hinged flapper valve 102 that may be supported from the hinge point on the chassis 110 by two arms 128 that permit the same hinge geometry as certain replacement toilet flappers on the market so that the flapper may sit on the seat 108 in the same way as the existing or standard replacement flapper. The dual-detent toilet flush flapper 102 may be opened by the existing chain 104 or by a chain that is identical to that of most toilets and may utilize the existing handle and arm assembly. In other embodiments, the toilet flush handle may be the toilet's existing handle or be a new one installed with the toilet flush assembly of the invention. There may be two detent latching mechanisms 130, one on either side of the flapper 102 and the detent latching mechanism may utilize the respective pivot arm 128 of the flapper to hold the flapper in the open position. When the user pushes the toilet handle, the chain 104 lifts the flapper 102 away from its seat 108. However, when the flapper pivots upward and rises part way from its seat, the first flush pivot arm 128 may intercept a detent 130 that may lock it into the first open position. At this point, the user may feel resistance on the handle and in this way is notified that the first opening position may be reached. If the user continues to apply pressure to the handle of the toilet, overcoming the resistance, the flapper may continue to pivot open until the opposite pivot arm intercepts a detent (not shown) that locks it into a second flush open position. The two locked open positions correspond to the amount of water that may be released during the flush. The two detents may operate in the same way to hold open the flapper and employ two parallel and separate release mechanisms. Each side of the assembly may have a track 114 upon which travels a detent rack 118 that glides freely in the vertical axis. Mounted to the detent rack 118 via continuous locking teeth 116 and adjustable vertically for the entire height of the detent rack on each side of the assembly may be a float 120, 124 that has a tuned buoyancy. The buoyancy of each float 120, 124 may create an upward force upon each detent rack and provide a force to the detent itself which is held against the bearing surface of the flapper arm. When the flapper 102 is opened, the detent may immediately engage with the slot in the flapper arm as it rotates into direct proximity. When the flapper 102 is opened, water may begin to drain from the tank and, as the water level drops, it may eventually encounter the level of the float. When the water level drops below the level of the float 120, 124 the float loses buoyancy. At this point, a water weight carried by the upper float reservoir 122 may create a negative buoyancy and this disengagement force, now downward, may cause the detent to disengage from the flapper arm. The flapper 102, which may be high density, may drop closed on its seat 108. Each float may be set at a different height on the detent rack 118 and that setting may determine how much water is released with the first flush and the second flush. The long vertical height of the detent rack 118 may enable the dual-detent toilet flush assembly to be used in a variety of toilets, accommodating great variation in tank volume and water height, both full and empty.

Figure 2:
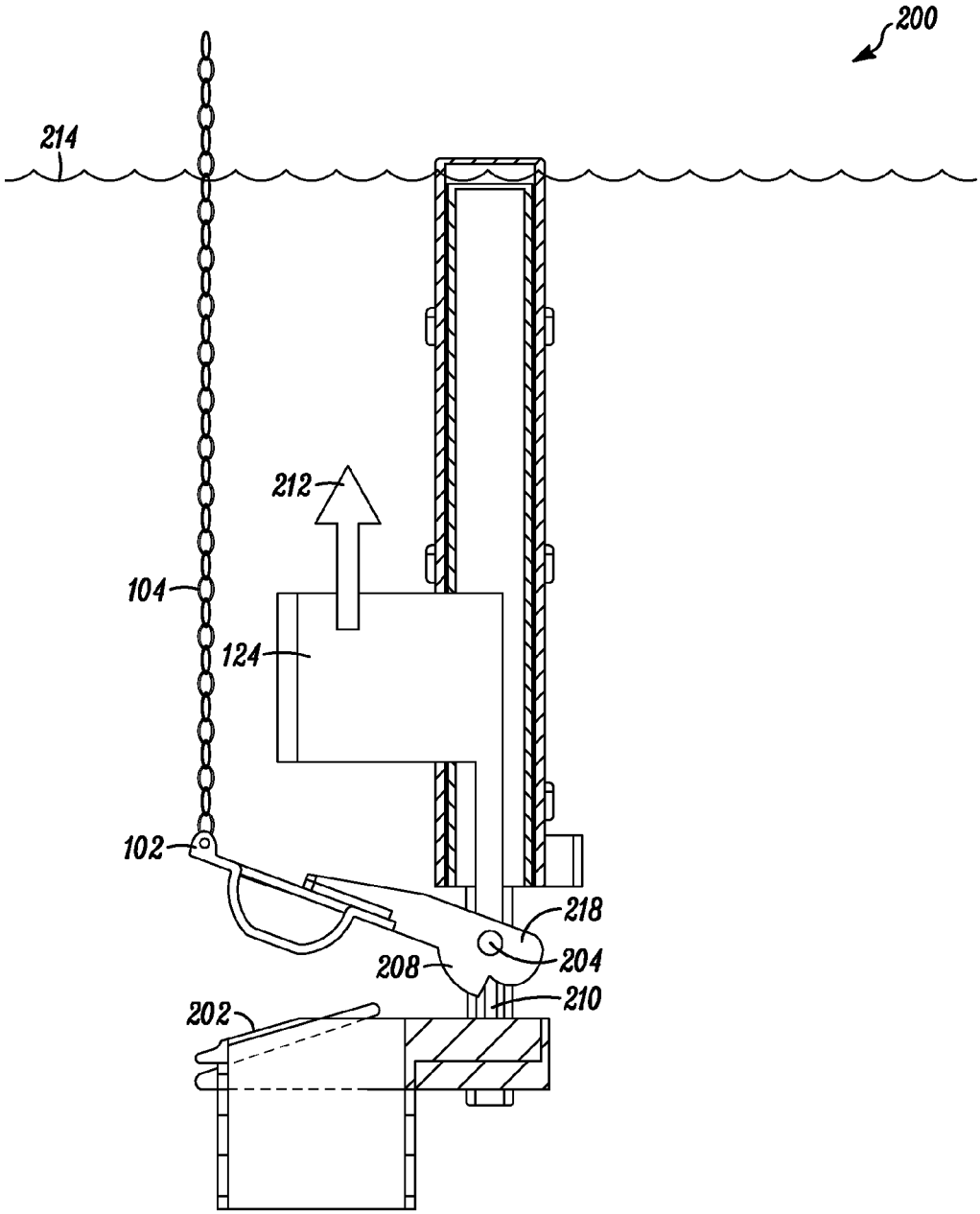
FIG. 2 depicts a section view of the dual-detent toilet flush assembly showing the half-flush detent mechanism.

Referring now to FIG. 2, the first flush may be created by the one side of the dual-detent toilet flush assembly mechanism, such as the left side. When the user pushes on the toilet handle, the handle mechanism pulls on the chain 104 connected to the toilet flapper 102 and the force pivots the flapper at the pivot point 204 on the tower, lifting it off its seat 202 and initiating a flush and draining of water from the tank. However, when the flapper pivots upward, rotating on the tower mounted pivot pin 204, it rises part way from the seat and the first flush pivot arm 218 may be intercepted by the first flush detent wedge latch 210 that may lock it into the first-open position. At this point, the user may feel resistance on the handle and in this way is notified that the first opening position may be reached. The buoyancy of the first flush float 124 creates an upward force 212 upon the first flush detent rack which may provide a force to the first flush detent wedge latch 210 itself which is held against the bearing surface of the valve arm. When the valve is opened, the first flush detent wedge latch 210 may immediately engage with the slot 208 in the flapper arm as it rotates into direct proximity. When the flapper is raised, water may begin to drain from the tank and as the water level 214 drops it eventually encounters the level of the first flush float 124. When the water level 214 drops below the level of the first flush float 124, the float may lose buoyancy. At this point, a water weight carried by the upper float reservoir may create negative buoyancy and this disengagement force, now downward, may cause the first flush detent wedge latch 210 to disengage from the flapper arm. The flapper 102, which may be high density, may drop closed on the seat 202 shutting off the flow of water.

Figure 3:
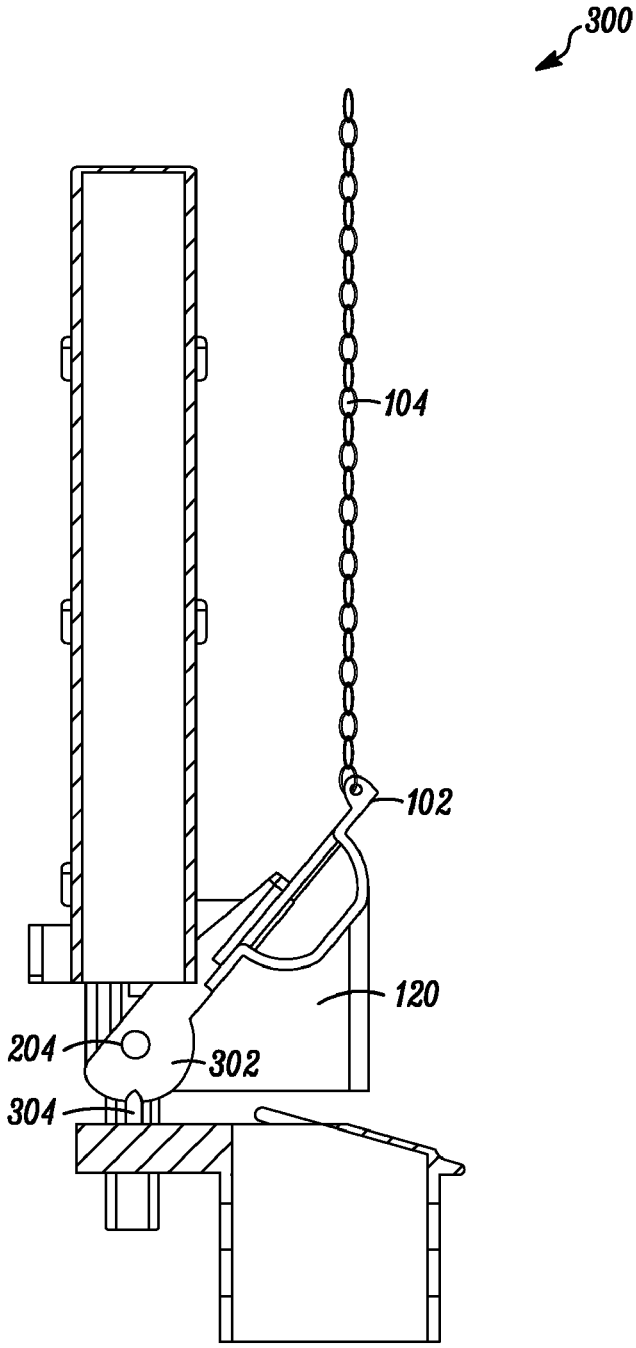
FIG. 3 depicts a section view of the dual-detent toilet flush assembly showing the full-flush detent mechanism.

Referring to FIG. 3, the second flush may be created by an opposite side of the dual-detent toilet flush assembly 100, such as the right side. When the user pushes on the toilet handle with sufficient force to overcome any resistance associated with the first flush position, the handle mechanism pulls on the chain 104 connected to the toilet flush flapper 102 and the force pivots the flapper at the pivot point 204 on the tower, lifting it off the seat and initiating a flush. However, when the flapper pivots upward, rotating on the tower mounted pivot pin 204, it may rise all the way from the seat and the second flush pivot arm 302 may be intercepted by the second flush detent wedge latch 304 that locks it into the second open position. The buoyancy of the second flush float 120 may create an upward force upon the detent rack which may provide a force to the second flush detent wedge latch 304 itself which may be held against the bearing surface of the second flush flapper arm 302. When the flapper 102 is opened, the second flush detent wedge latch may immediately engage with the slot 302 in the flapper arm as it rotates into direct proximity. When the flapper is opened, water may begin to drain from the tank and as the water level drops it eventually encounters the level of the float. When the water level drops below the level of the float 120, the float may lose buoyancy. At this point, a water weight carried by the upper float reservoir may create negative buoyancy and this disengagement force, now downward, may cause the second flush detent wedge latch 304 to disengage from the flapper arm. The flapper 102, which may be high density, may drop closed on the seat shutting off the flow of water.

Figure 4:
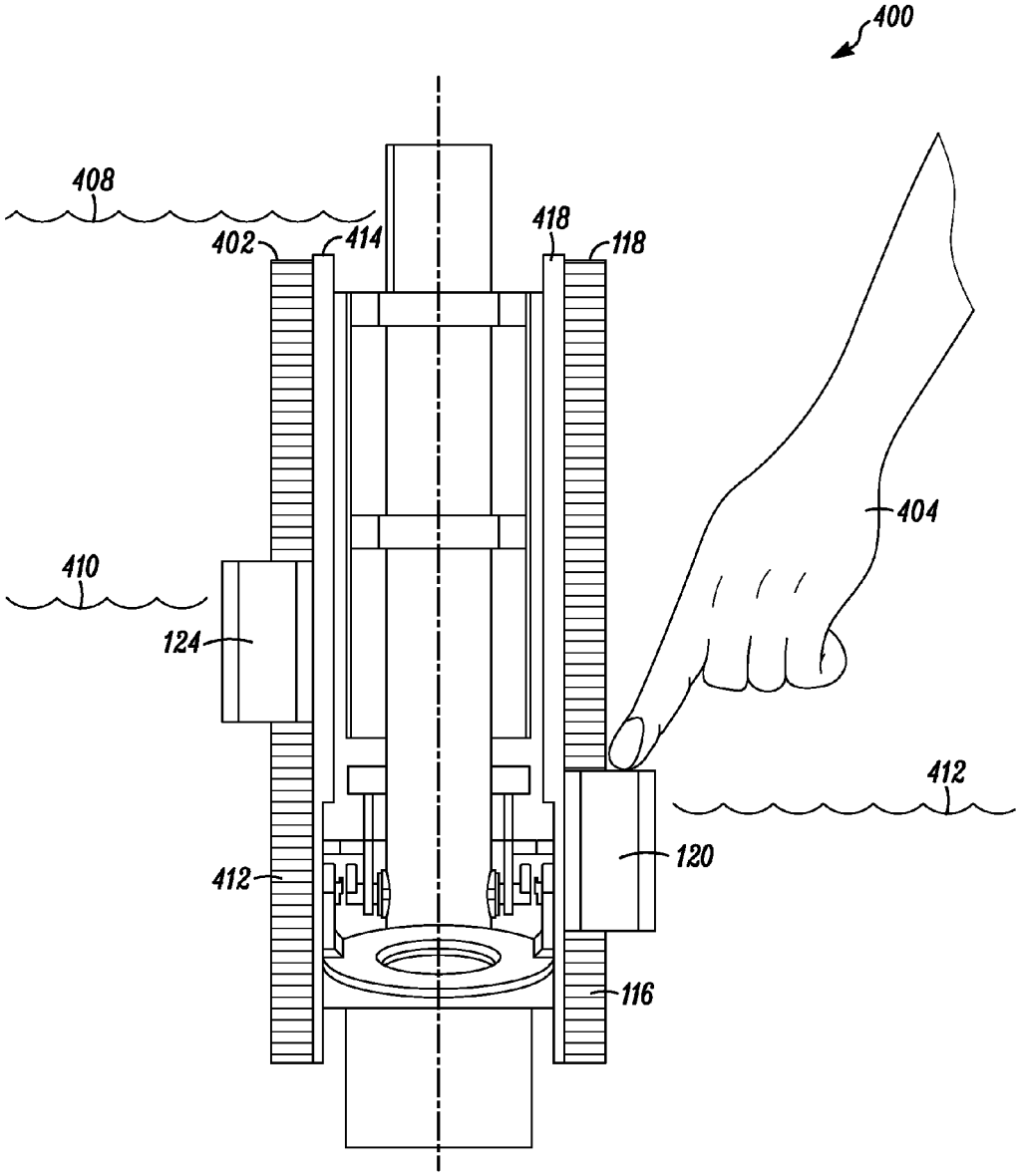
FIG. 4 depicts a front view of the dual-detent toilet flush assembly showing the adjustment of the float level.

Referring to FIG. 4, the dual-detent toilet flush assembly may be adjustable to provide two distinctly different volumes of water for the first flush and for the second flush. Thus, it should be understood that the volume of water drained from the toilet tank during the first flush and second flush, as described herein, may be modified such that the amount of water drained during the two flushes can be any volume set by the user by simply altering the starting position of the floats 120, 124 along the detent rack. In an embodiment, the first flush may be a half flush and the second flush may be a full flush. Each side of the assembly 400 may be an independent system with a separate detent and float. The toilet flapper may be latched either at the first flush detent or the second flush detent. In an embodiment, only one side of the assembly 400 may work at a time. When latched at the first flush detent, the higher first flush float only will determine the release point for the flapper. When the water level in the tank 408 drops as the flapper is opened, it may reach a level 410 when the float no longer provides positive buoyancy and the detent wedge latch may be released. When latched at the second flush detent, the lower second flush float only may determine the release point for the flapper. When the water level in the tank 408 drops as the valve is opened, it will reach a level 412 when the float no longer provides positive buoyancy and the detent wedge latch may be released. Both detents may operate in the same way to hold open the flapper and may employ two parallel and separate release mechanisms. Each side of the assembly may have a track 414, 418 upon which may travel a detent rack 118, 402 that glides freely in the vertical axis. Mounted to the detent rack 118, 402 via continuous locking teeth 116, 412 and adjustable vertically for the entire height of the detent rack on each side of the assembly may be a float 120, 124 that has a tuned buoyancy. The float 120, 124 may utilize a spring clip that engages the locking teeth 116, 412 and pressure by the user's hand 404 may move the floats 120, 124 up and down the detent racks 118, 402. The user 404 may be able to set each float at a different height on the detent rack and the setting may determine how much water is released with the first flush and second flush as the dropping water level reaches that float and disengages the detent wedge latch. The long vertical height of the detent rack 118, 402 may enable the dual-detent toilet flush assembly to be used in a variety of toilets, accommodating great variation in tank volume and water height 408, both full and empty.

Figure 5:
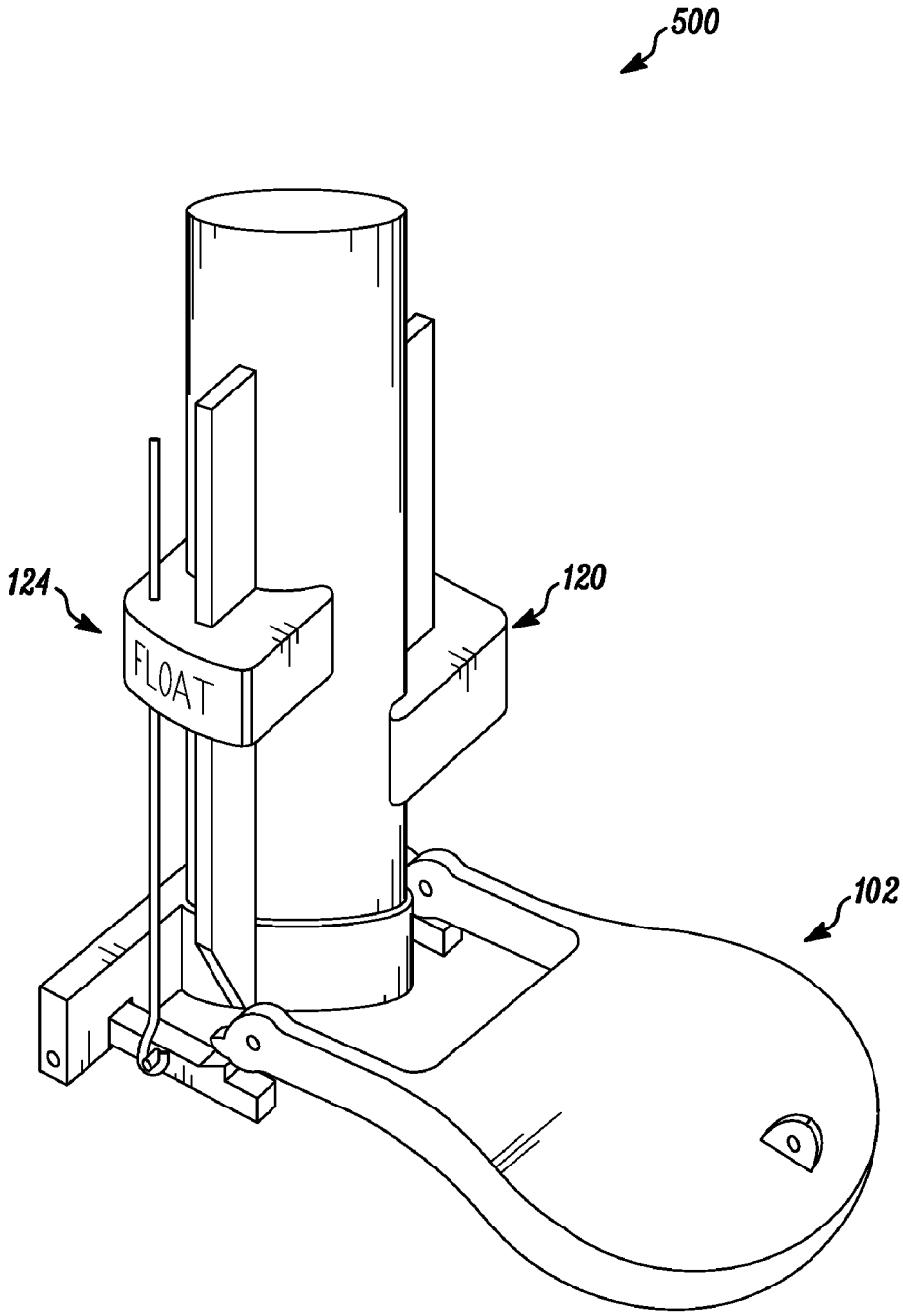
FIG. 5 depicts a perspective view of the dual-detent toilet flush assembly.
Figure 6:
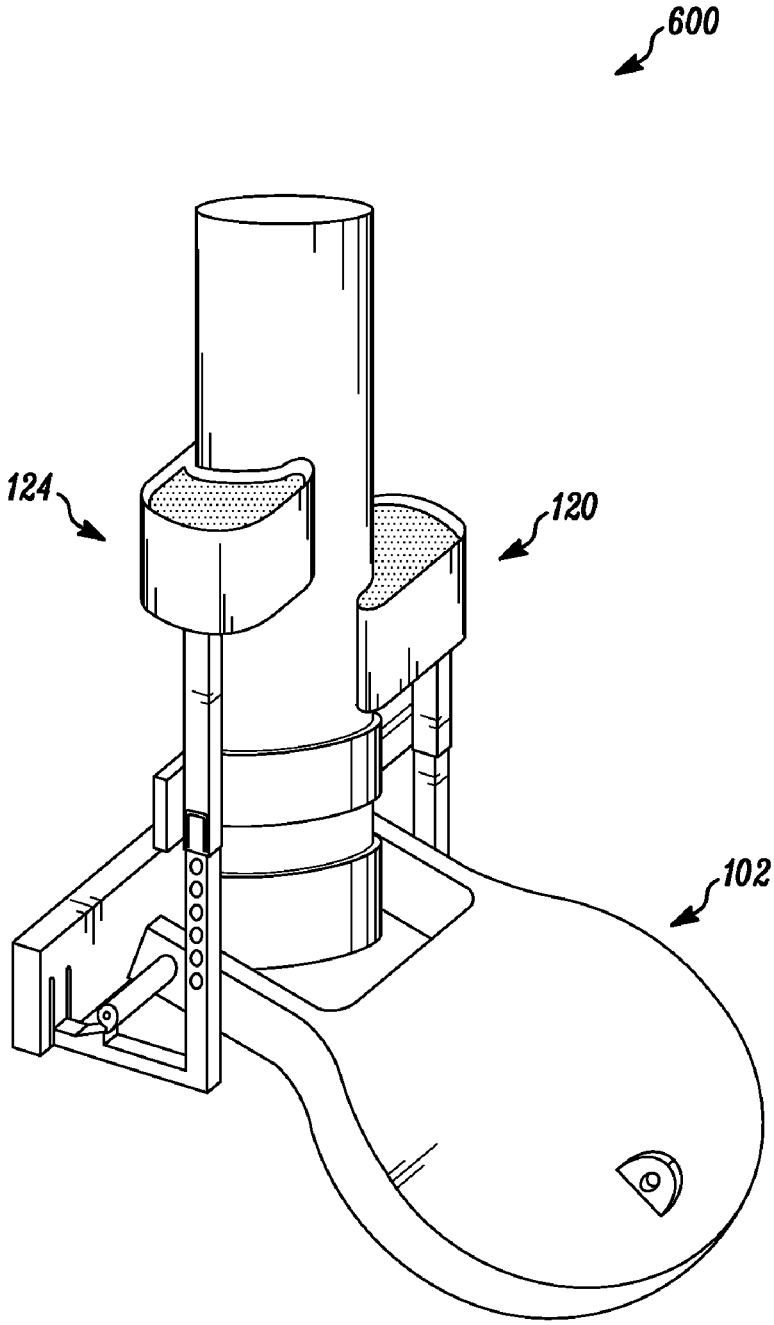
FIG. 6 depicts a perspective view of the dual-detent toilet flush assembly.

Referring to FIGS. 5 and 6, additional embodiments of the dual-detent toilet flush assembly are depicted. For example, in FIG. 5, the floats do not have integral water reservoirs.

Figure 7A:
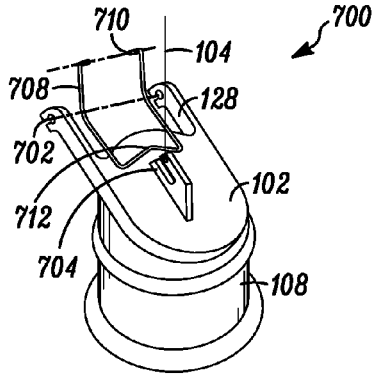
FIG. 7A. depicts a perspective illustration showing the 2-stage toilet flapper in a closed position.

Referring to FIG. 7A, a 2-stage toilet flapper assembly with tactile feedback 700 may enable the user to choose between a low volume flush, such as a half flush, and a second volume of flush, such as a full volume flush, depending upon the contents to be disposed. In the closed position, the flapper 102 may sit upon its seat 108 creating a water tight seal held in place by a column of water acting upon the surface area of the flapper. The flapper 102 may be positioned by a pair of pivot arms 128 that have a pivot axis 702 controlling the movement of the flapper when the user pulls the flapper open with a chain 104 that connects to the toilet flush handle on the external tank and to the flapper 102 with a multi-function connection boss 704. Independent of the flapper may be a spring metal wireform force clip 708 that pivots about an axis 710 and with an engagement indentation 712 that rests upon the flapper 102 top surface by gravity.

Figure 7B:
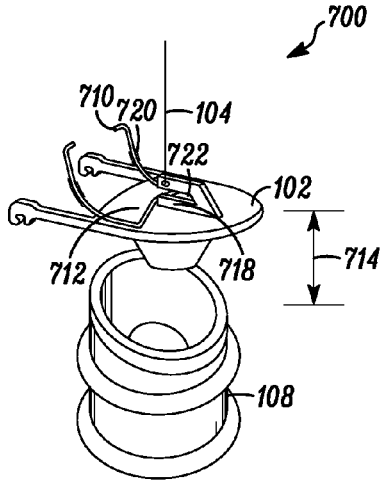
FIG. 7B. depicts a perspective illustration showing the 2-stage toilet flapper in a ½ flush position.

Referring now also to FIG. 7B, when the user flushes the toilet, the actuation of the external lever, the toilet flush handle, may pull the chain 104 upward raising the flapper 102 a small amount 714 above its seat 108. As the flapper lifts through its rotational arc the back surface of the multi-function connection boss 704 encounters the engagement indentation 712 of the spring metal wireform force clip 708 on its contoured rear surface 718 which also pivots on its axis 710 in response to the movement of the valve. When the two engage, the clip 708 inhibits the flapper's 102 further motion. The user may feel the impediment to lever motion and as more force is employed to overcome the resistance of the spring metal wireform force clip 708, the arms 720 of the clip may deform creating a stronger resistance at the flush handle and effectively stopping the motion at the first flush position. The multi-function connection boss 704 may have an entrapment feature 722 that can receive the spring metal wireform force clip 708 when enough force is applied to cause the clip to deform and snap off of the contoured rear surface 718 which will free the flapper 102 to rotate higher to a second flush position.

Figure 7C:
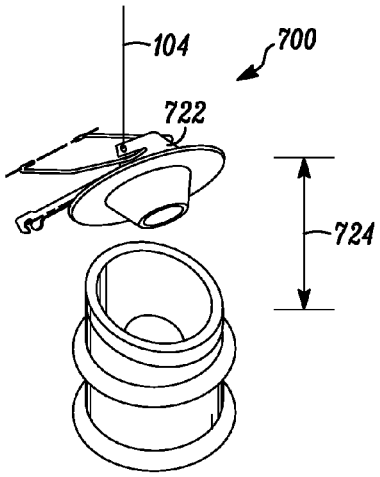
FIG. 7C. depicts a perspective illustration showing the 2-stage toilet flapper in a full flush position.

Referring now also to FIG. 7C, when the user desires to use a second flush, such as a full flush, the user may apply even more pressure to the handle and the resulting greater pull on the chain 104 will ultimately cause enough deformation in the arms 720 of the spring metal wireform force clip 708 that it will deform and snap off of the contoured rear surface 718 of the multi-function connection boss 704 which will free the flapper 102 to rotate higher 724 to the second flush position. When the spring metal wireform force clip 708 snaps free, it is retained by the entrapment feature 722 of the multi-function connection boss 704 that will keep it from interfering with the chain when the flapper drops closed.

Figure 8:
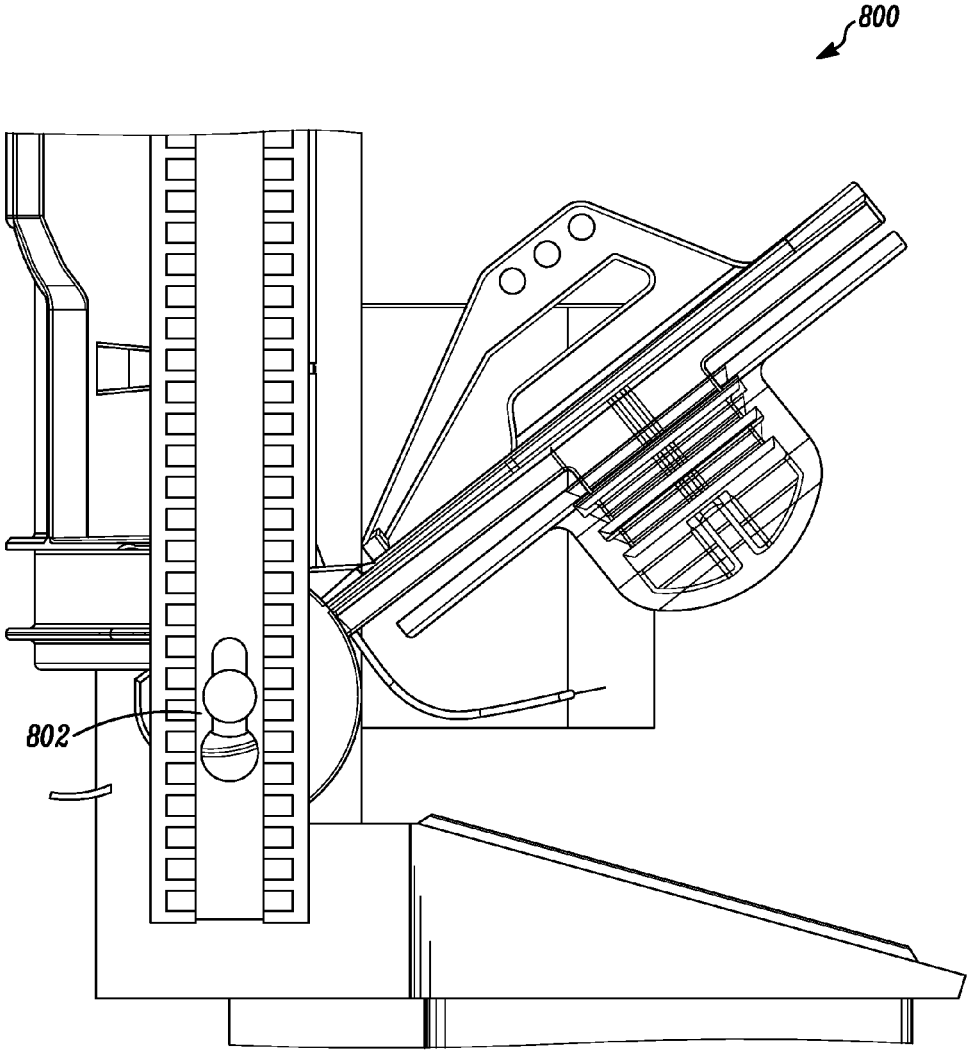
FIG. 8 depicts a side view of the flapper in an open position.

Referring to FIG. 8, an opening 802 in the detent mechanism to which the flapper is pivotably attached provides a stop for the travel of the detent mechanism after the flush float 120, 124 loses buoyancy and a water weight carried by the upper float reservoir creates a negative buoyancy and a downward disengagement force. The opening 802 also provides a stop for the travel of the detent mechanism when water refills the tank and the flush float 120, 124 regains buoyancy.

Figure 9A:
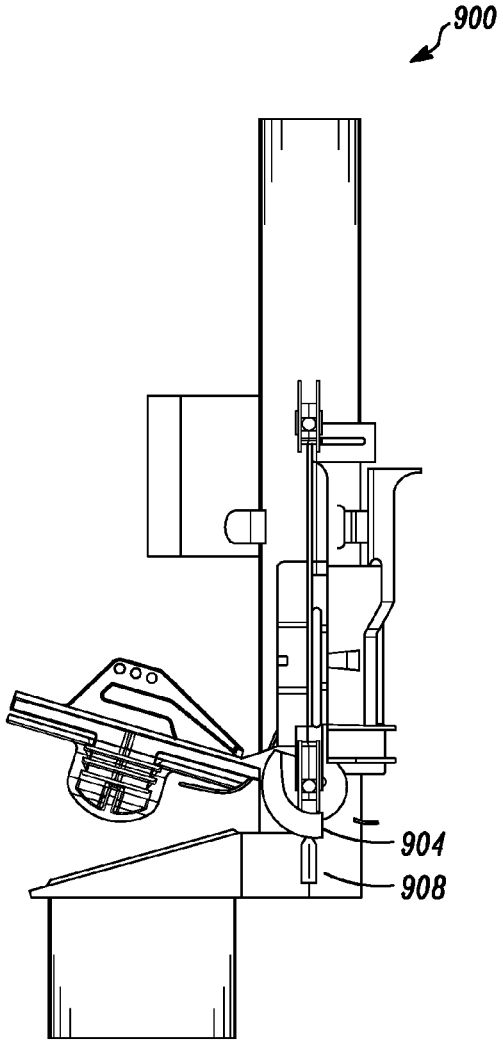
FIGS. 9 A & B depict side views of a first flush position (A) and a second flush position (B).
Figure 9B:
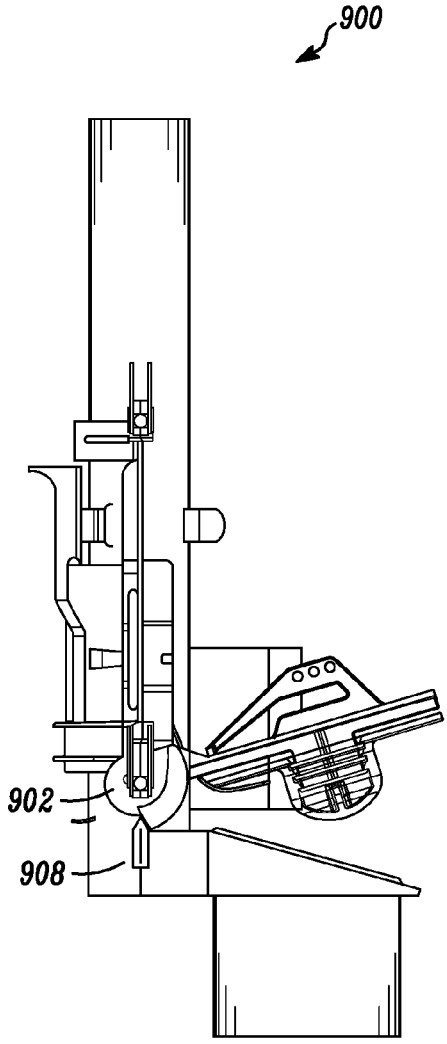

Referring to FIG. 9, both sides of the flapper and assembly are shown when the flapper is open to a first flush position. In FIG. 9B, the first flush pivot arm 902 has engaged the detent 908 but, as shown in FIG. 9A, the second flush pivot arm 904 has not yet engaged the detent 908. Thus, only the first flush pivot arm 902 needs to disengage in order to allow the flapper to close. When the toilet flush handle is pushed such that the second flush pivot arm 904 engages the detent 908, only the second flush pivot arm 904 needs to disengage in order to allow the flapper to close. When the water level passes the first flush float such that it loses buoyancy and a water weight in its reservoir causes a downward force, the detent mechanism on the same side as the first flush float may shift downward, but will have no effect on the flapper latched open to the second flush position. As water continues to drain until passing the level of the second flush float, the second flush float loses buoyancy and a water weight in its reservoir causes a downward force and the detent mechanism on the same side as the second flush float may shift downward disengaging the second flush pivot arm and causing the flapper to close. Since the detent on the other side of the assembly has already shifted downward, it will not be in the way of the flapper rotating shut.

In an aspect of the invention, a dual-detent toilet flush assembly 100, may include a flapper 102 pivotally attached to a detent mechanism, wherein a connector 104 is attached to a toilet flush handle on one end and to a connection point of the flapper on the other end, wherein when a user engages the toilet flush handle, the connector lifts the flapper 102 away from a flapper seat 108, a first flush pivot arm 218 attached to a first side of the flapper 102, wherein the first flush pivot arm 218 interacts with a detent mechanism when the flapper 102 rises part way from the flapper seat and holds the flapper open in a first open position, a second flush pivot arm 302 attached to a second side of the flapper, wherein the second flush pivot arm 302 interacts with a detent mechanism when the flapper rises to a second open position where it is held open, a first flush float 124 associated with the detent mechanism on the same side of the assembly as the first flush pivot arm 218, wherein the buoyancy of the float creates a force upon the detent mechanism, a second flush float 120 associated with the detent mechanism on the same side of the assembly as the second flush pivot arm 302 and at a position different from the first flush float 124, wherein the buoyancy of the second flush float 120 creates a force upon the detent mechanism, wherein when the flapper is opened to a first flush position upon engagement of the toilet flush handle: a) the first flush pivot arm 218 tilts and interacts with the detent mechanism on the same side of the assembly 100 as the first flush pivot arm 218 to allow the detent mechanism to move in response to a change in the water level; b) upon a drop in water level, the detent mechanism shifts downward 210; c) at an endpoint of the downward shift of the detent mechanism, the first flush pivot arm 218 disengages from the detent mechanism and the flapper drops closed on the flapper seat, and wherein when the flapper is opened to a second flush position upon engagement of the toilet flush handle: a) the second flush pivot arm 302 tilts and interacts with the detent mechanism on the same side of the assembly as the second flush pivot arm 302 to allow the detent mechanism to move in response to a change in the water level, b) upon a drop in water level, the detent mechanism shifts downward, c) at an endpoint of the downward shift of the detent mechanism, the second flush pivot arm 302 disengages from the detent mechanism and the flapper drops closed on the flapper seat. The detent mechanism may be any portion of the assembly 100 that is responsible for latching open the flapper, such as the detents 210, 304, detent rack 118, or track 114. A user may feel resistance on the toilet flush handle when the first flush pivot arm interacts with the detent mechanism. The resistance may arise when the flapper opening to a first flush position causes a clip 708 disposed on the top of the flapper and rotating on an axis to contact a surface of a connection boss of the flapper and inhibit the flapper's further motion. As more force is employed to overcome the resistance of the clip 708, the arms 720 of the clip may deform creating a stronger resistance at the lever and effectively stopping the motion of the flapper at the first flush position. The clip 708 may be a spring metal wireform force clip. When enough force is applied, the clip 708 may deform and snap off of the surface 718 of the connection boss 704 thereby freeing the flapper to rotate to the second flush position. The clip may snap into an entrapment feature 722 of the connection boss 704 keeping it from interfering with the chain when the flapper drops closed. In the assembly, the first and second flush positions correspond to two different amounts of water that may be released during the flushes. In the assembly, the first and second flush floats 120, 124 may be repositionable along the detent mechanism to modify the amount of water released during each flush. In the assembly, the connector may be a chain. In the assembly, upon the drop in water level, the first flush float may lose buoyancy and a water weight carried by an upper float reservoir of the first flush float may create a negative buoyancy and a downward disengagement force sufficient to cause the downward shift of the detent mechanism. In the assembly, upon the drop in water level, the second flush float may lose buoyancy and a water weight carried by an upper float reservoir of the second flush float may create a negative buoyancy and a downward disengagement force sufficient to cause the downward shift of the detent mechanism. In the assembly, the first flush pivot arm may interact with the detent mechanism through a slot in the first flush pivot arm engaging a detent 210 of the detent mechanism as the first flush pivot arm rotates into direct proximity of the detent 210. In the assembly, the second flush pivot arm may interact with the detent mechanism through a slot in the second flush pivot arm engaging a detent 304 of the detent mechanism as the second flush pivot arm rotates into direct proximity of the detent 304.

In an aspect of the invention, a kit for in situ retrofitting a gravity tank toilet for enabling a user to select between two flush volumes may include a detent mechanism assembly, at least one float slidably attached to the detent mechanism assembly, and a flapper pivotably attached to the detent mechanism assembly, wherein installation of the detent mechanism assembly in the gravity tank toilet is accomplished without removal of an existing tank. In the kit, installation of the detent mechanism assembly in the gravity tank toilet may utilize an existing flapper seat. In the kit, the at least one float is repositionable along the detent mechanism assembly to enable two selected flush volumes. The selected flush volumes may be based on a parameter of the gravity tank toilet. The selected flush volumes may be selected based on a preference of a user. An embodiment of the kit is depicted in FIG. 1, wherein the kit is shown installed on an existing tower 112 and utilizing an existing flapper seat 108. The chain 104 may or may not be included as part of the kit. It should be understood that many other configurations of the kit are possible and are all within the scope of this disclosure.

In an aspect of the invention, a kit for in situ retrofitting a gravity tank toilet for enabling a user to utilize an existing toilet flush handle to enable a dual flush mechanism may include a detent mechanism assembly, at least one float slidably attached to the detent mechanism assembly, and a flapper pivotably attached to the detent mechanism assembly, wherein installation of the detent mechanism assembly in the gravity tank toilet utilizes an existing toilet flush handle. The kit may further include a clip disposed on the top of the flapper, wherein the clip is adapted to rotate on an axis to contact a surface of a connection boss of the flapper and inhibit the flapper's motion. An embodiment of the kit is depicted in FIG. 1, wherein the kit is shown installed on an existing tower 112 and utilizing an existing flapper seat 108. The chain 104 may or may not be included as part of the kit. It should be understood that many other configurations of the kit are possible and are all within the scope of this disclosure.

While the invention has been disclosed in connection with the preferred embodiments shown and described in detail, various modifications and improvements thereon will become readily apparent to those skilled in the art. Accordingly, the spirit and scope of the present invention is not to be limited by the foregoing examples, but is to be understood in the broadest sense allowable by law.

All documents referenced herein are hereby incorporated by reference.

What is claimed is:

1. A dual-detent toilet flush assembly, comprising:

a flapper;

a connector attached to a toilet flush handle on one end and to a connection point of the flapper on the other end, wherein when a user engages the toilet flush handle, the connector lifts the flapper away from a flapper seat;

a first detent mechanism;

a first flush pivot arm attached to a first side of the flapper, wherein the first flush pivot arm interacts with the first detent mechanism when the flapper rises part way from the flapper seat such that the first detent mechanism holds the flapper open in a first open position;

a second detent mechanism;

a second flush pivot arm attached to a second side of the flapper, wherein the second flush pivot arm interacts with the second detent mechanism when the flapper rises to a second open position where the flapper is held open by the second detent mechanism;

a first flush float associated with the first detent mechanism on the same side of the assembly as the first flush pivot arm, wherein a buoyancy of the first flush float creates a force upon the first detent mechanism;

a second flush float associated with the second detent mechanism on the same side of the assembly as the second flush pivot arm and at a position different from the first flush float, wherein buoyancy of the second flush float creates a force upon the second detent mechanism;

wherein, when the flapper is opened to a first flush position upon engagement of the toilet flush handle:

a) the first flush pivot arm tilts and interacts with the first detent mechanism to allow the first detent mechanism to move in response to a change in a water level;

b) upon a drop in the water level to a first level the first detent mechanism shifts downward to disengage the first flush pivot arm from the first detent mechanism thereby releasing the flapper to close on the flapper seat; and wherein when the flapper is opened to a second flush position upon engagement of the toilet flush handle:

a) the second flush pivot arm tilts and interacts with the second detent mechanism to allow the second detent mechanism to move in response to the change in the water level;

b) upon a drop in the water level to a second level, the second detent mechanism shifts downward to disengage the second flush pivot arm from the second detent mechanism thereby releasing the flapper to close on the flapper seat.

2. The assembly of claim 1, further comprising a clip disposed on a top of the flapper and positioned and oriented to inhibit movement of the flapper past the first flush position.

3. The assembly of claim 2, wherein the clip is a spring metal wireform force clip.

4. The assembly of claim 2 wherein the clip is deformable to permit a movement of the flapper past the first position upon an application of sufficient force to the toilet flush handle, the flapper further comprising snaps-into an entrapment feature that engages the clip to prevent a movement of the flapper past the second position.

5. The assembly of claim 1, wherein the first and second flush positions correspond to two different amounts of water that are released during the flushes.

6. The assembly of claim 1, wherein the first and second flush floats are repositionable along the first and second detent mechanisms respectively to modify an amount of water released during each flush.

7. The assembly of claim 1, wherein the counector is a chain.

8. The assembly of claim 1, wherein the first flush float includes an upper float reservoir that holds an amount of water with a downward disengagement force sufficient to shift the first detent mechanism downward.

9. The assembly of claim 8, wherein the second flush float includes a second upper float reservoir that holds a second amount of water with a second downward disengagement force sufficient to shift the second detent mechanism downward.

10. The assembly of claim 1, wherein the first flush pivot arm interacts with the first detent mechanism through a first slot in the first flush pivot arm engaging a first detent of the first detent mechanism as the first flush pivot arm rotates into direct proximity of the first detent.

11. The assembly of claim 10, wherein the second flush pivot arm interacts with the second detent mechanism through a second slot in the second flush pivot arm engaging a second detent of the second detent mechanism as the second flush pivot arm rotates into direct proximity of the second detent.

* * * * *